US005302131A

United States Patent [19]

Heritier-Best et al.

[11] Patent Number: 5,302,131

[45] Date of Patent: Apr. 12, 1994

[54] CONNECTOR CAP FOR LINKING ELECTRICAL CABLE

[75] Inventors: Pierre Heritier-Best, Orbeil; Franck Sauzedde, Veyre-Monton, both of France

[73] Assignee: Sagem Allumage, Paris, France

[21] Appl. No.: 962,650

[22] Filed: Oct. 19, 1992

[30] Foreign Application Priority Data

Oct. 21, 1991 [FR] France ..... 91 12968

[51] Int. Cl.[5] ..... H01R 13/44

[52] U.S. Cl. ..... 439/127; 123/143 C

[58] Field of Search ..... 439/125–130; 123/143 C, 169 PH

[56] References Cited

U.S. PATENT DOCUMENTS 2,115,011 4/1938 Douglas .
2,835,724 5/1958 Colbert ..... 123/143 C
2,943,139 6/1960 Skunda ..... 439/125 X
3,104,658 9/1963 Olsen ..... 123/143 C
4,443,047 4/1984 Hofmann ..... 439/128
4,566,751 1/1986 Yoshida et al. .
4,790,767 12/1988 Sturdevan et al. .

FOREIGN PATENT DOCUMENTS 2730084 1/1979 Fed. Rep. of Germany ..... 439/125
1205573 9/1970 United Kingdom ..... 439/125

*Primary Examiner*—Eugene F. Desmond
*Attorney, Agent, or Firm*—Dennison, Meserole, Pollack & Scheiner

[57] ABSTRACT

The subject of the present invention is a connector cap for linkage between an electrical cable and an elbowed high-voltage output shaft (1; 20; 35, 35') of an ignition device (2; 19). To that end, it includes locking means (8; 14; 22; 31; 32) for locking it counter to a movement in a direction parallel to the cable axis.

10 Claims, 4 Drawing Sheets

CONNECTOR CAP FOR LINKING ELECTRICAL CABLE

BACKGROUND OF THE INVENTION

The present invention relates to a connector cap for linkage between an electrical cable and an elbowed high-voltage output shaft of an ignition device.

It is well-known that there is a need to prevent misfiring in internal combustion engines that are equipped with a catalytic converter. When misfiring occurs, the gasoline located in the cylinder is sent directly to the catalytic converter and soon damages it.

Consequently, it is essential to assure the electrical continuity of the spark plug power supply circuit, in other words the high-voltage circuit between this spark plug and the output of the ignition device, coil, igniter or distributor. This electrical circuit is made up of a high-voltage cable, one end of which is mounted on the spark plug and the other end of which is mounted on the high-voltage shaft of the ignition device.

Disconnection of the cable from the high-voltage shaft can occur either from incorrect placement, for instance during a repair operation, or from the shocks or vibration that normally occurs during operation of the engine on which the ignition device is mounted.

Solutions to this problem have already been proposed, for straight high-voltage shafts. These solutions employ an intermediate connection device between the cable and the shaft. This device is in the form of a pancake, with the high-voltage cable connected in its plane. This pancake is connected to the ignition device by latching in a direction perpendicular to the axis of the cable.

However, this intermediate device has the disadvantage of being bulky. Moreover, this solution is not applicable to the case of elbowed high-voltage shafts.

The present invention seeks to overcome these disadvantages.

SUMMARY OF THE INVENTION

To this end, the subject of the invention is a connector cap for linkage between an electrical cable and an elbowed high-voltage output shaft of an ignition device, characterized in that it includes locking means for locking it counter to a movement in a direction parallel to the axis of the cable.

This cap has the advantage of being very simple to make in one piece with its locking means.

In a particular embodiment, the locking means include a flange substantially perpendicular to the axis of the cable, embodied in one piece with the cap on its side opposite the cable output, and arranged to press behind a stop surface of the shaft.

In this embodiment, the cap is consequently held directly by the high-voltage shaft, regardless of the configuration of the latter compared with any other shafts that may be present.

The flange may include a reinforcement that is capable of receiving a catch protuberance formed on the surface of the shaft.

A traction tongue may be provided on the side of the cap opposite the cable output, for putting the flange in place behind the stop surface of the shaft.

In the event that a plurality of high-voltage output shafts are provided side-by-side on the ignition device, the respective caps may be joined together by a first yoke, made in one piece with the caps in the extension of their respective flanges.

The caps may also be joined by a second yoke perpendicular to the first, the second yoke advantageously being separated from the first yoke in the spaces located between the caps.

An arrangement of this kind makes it easy to put the set of caps in place on the ignition device; in particular, the user can grasp the set of caps by the first yoke, with his fingers passing through the spaces provided between the first and second yokes.

In a second embodiment, the locking means include at least one tongue projecting from the side of the cap opposite the cable output, and this tongue is provided with catch means on its end; the end of the tongue of another cap is located substantially facing the first cap, with its cable output opposite the cable output of the first cap.

It will be noted that this embodiment cannot be employed unless the ignition device has at least two opposed high-voltage shafts.

In this embodiment, it is also possible to join a set of caps by a yoke parallel to the axis of the cables.

In all these cases of a set of caps joined to one another, the cables that individually emerge from each cap may be reunited in a common sheath.

BRIEF DESCRIPTION OF THE DRAWINGS

Exemplary embodiments of the invention, which are understood to be non-limiting, will now be described in conjunction with the accompanying schematic drawings, in which.

DESCRIPTION OF THE INVENTION

Figure 1:
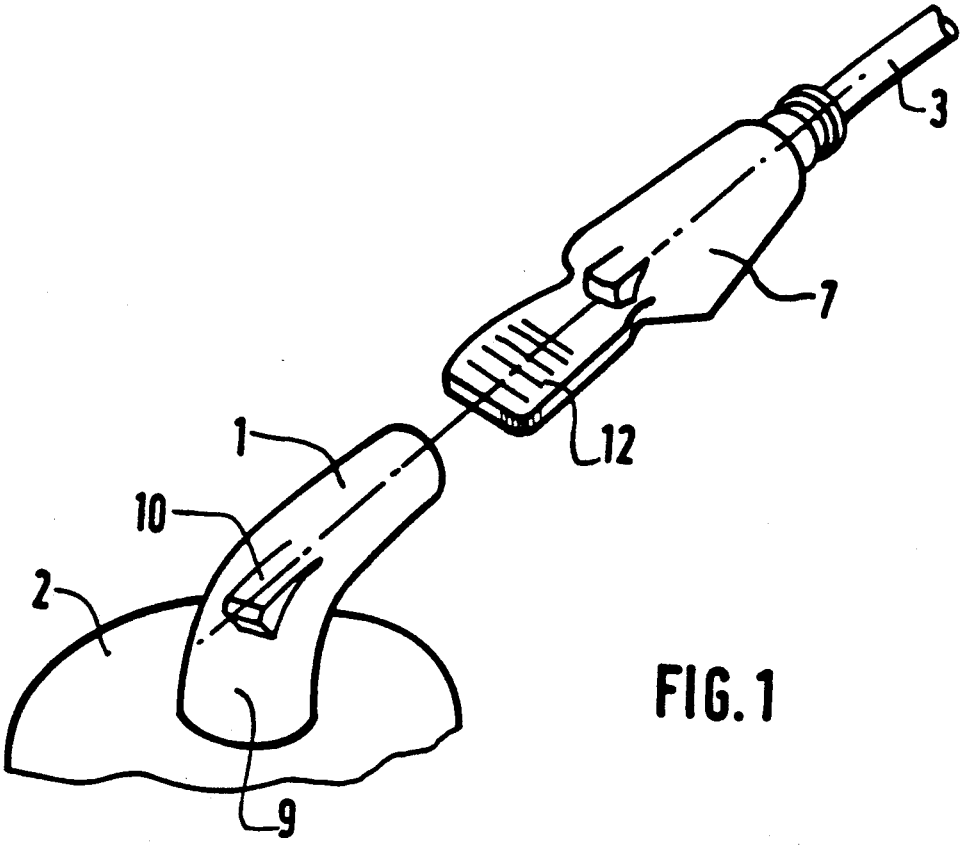
FIG. 1 is a perspective view of a cap according to the invention and the shaft to which it must adapt.

An elbowed high-voltage output shaft 1 of an ignition device 2 can be seen in FIG. 1. This high-voltage output is connected to a spark plug, not shown, by a high-voltage cable 3. On its end, the cable includes a linkage bracket 4 for its connection to the end 5 of the high-voltage output lead 6 of the shaft 1 by any known means.

According to the invention, the end of the cable 3 includes a cap 7, made of silicone rubber, for instance, which forms a cavity, in this case a substantially cylindrical one, that is capable of adapting to the head of the high-voltage shaft 1.

The cap 7 includes a flange 8 opposite and substantially perpendicular to the cable 3 and capable, upon connection of the cable, of pressing behind the surface 9 of the shaft 1 at the level where the shaft forms its elbow. In the present case, a catch protuberance 10 has also been provided on the stop surface 9 and is capable of engaging the inside of a reinforcement 11 of the flange 8 in order to assure better engagement of this flange with the surface 9 and consequently to increase the tractile force on the cable 3 that would be needed to pull the cap 7 off the shaft 1.

The flange 8 also has a traction tongue 12 making it possible to facilitate the passage of the flange 8 behind the surface 9 when the cap 7 is put in place.

It will be understood that to the limit of its strength, this flange 8, once it is in place, opposes any disconnection of the cable caused by traction in the axis of the cable.

Figure 2:
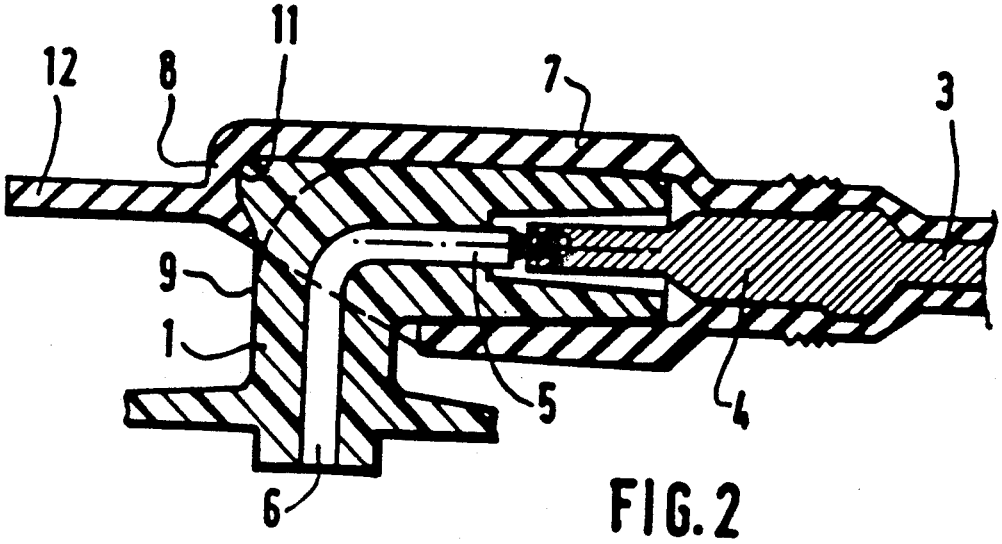
FIG. 2 is an axial sectional view of the cap of FIG. 1, mounted on its shaft.
Figure 3:
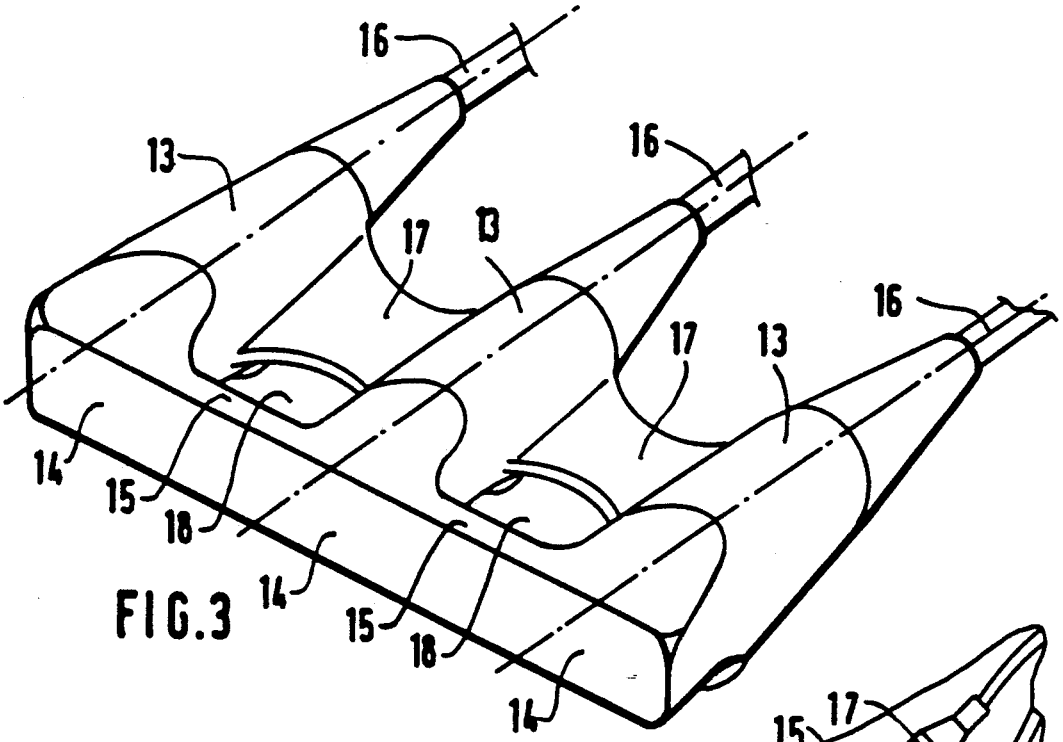
FIG. 3 is a perspective view of a set of caps like those of FIG. 1 joined to one another.
Figure 5:
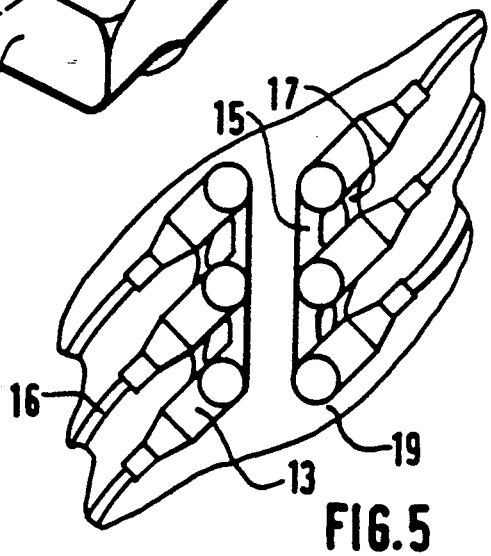
FIG. 5 is a view from above of an ignition device on which two sets of caps each in accordance with FIG. 3 are mounted.
Figure 4:
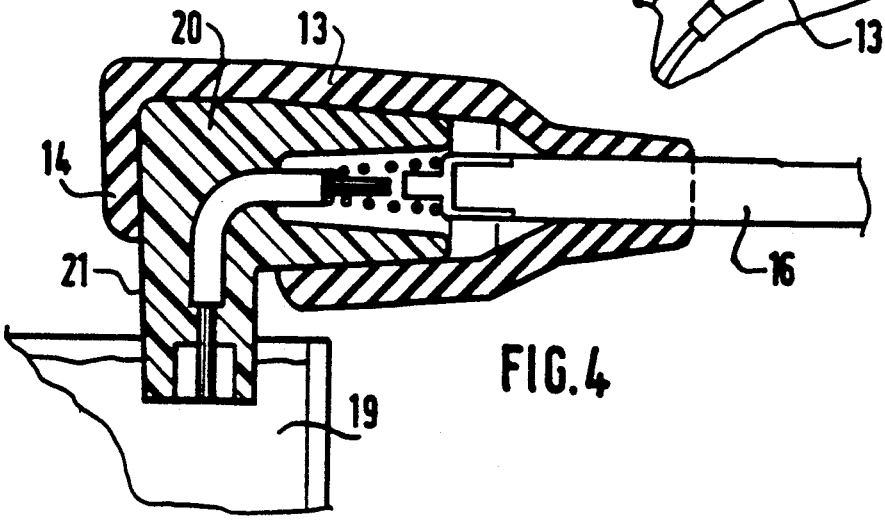
FIG. 4 is an axial sectional view of one of the caps of the set of FIG. 3, put in place on its output shaft.

Turning now to FIGS. 3-5, a set of three caps 13 is seen, which are of the same type as those of FIGS. 1 and 2 but are joined together.

The flanges 14 of these caps are in fact made in one piece with a yoke 15 formed in their extension; the flanges 14 and the yoke 15 consequently form a single casing that is perpendicular to the axes of the output cables 16.

The bodies of the caps 13 are also joined by a yoke 17, which is parallel to the axes of the cables 16 and consequently perpendicular to the casing 14-15. Spaces 18 are made between the yoke 17 and the yoke 15, so as to allow the fingers of a user to pass through them.

FIG. 4 shows the set of FIG. 3 mounted on an ignition device 19 provided with elbowed shafts 20. It can be seen that the flanges 14 are pressed behind the stop surfaces 21 of the shafts 20 opposite the cable 16.

Figure 6:
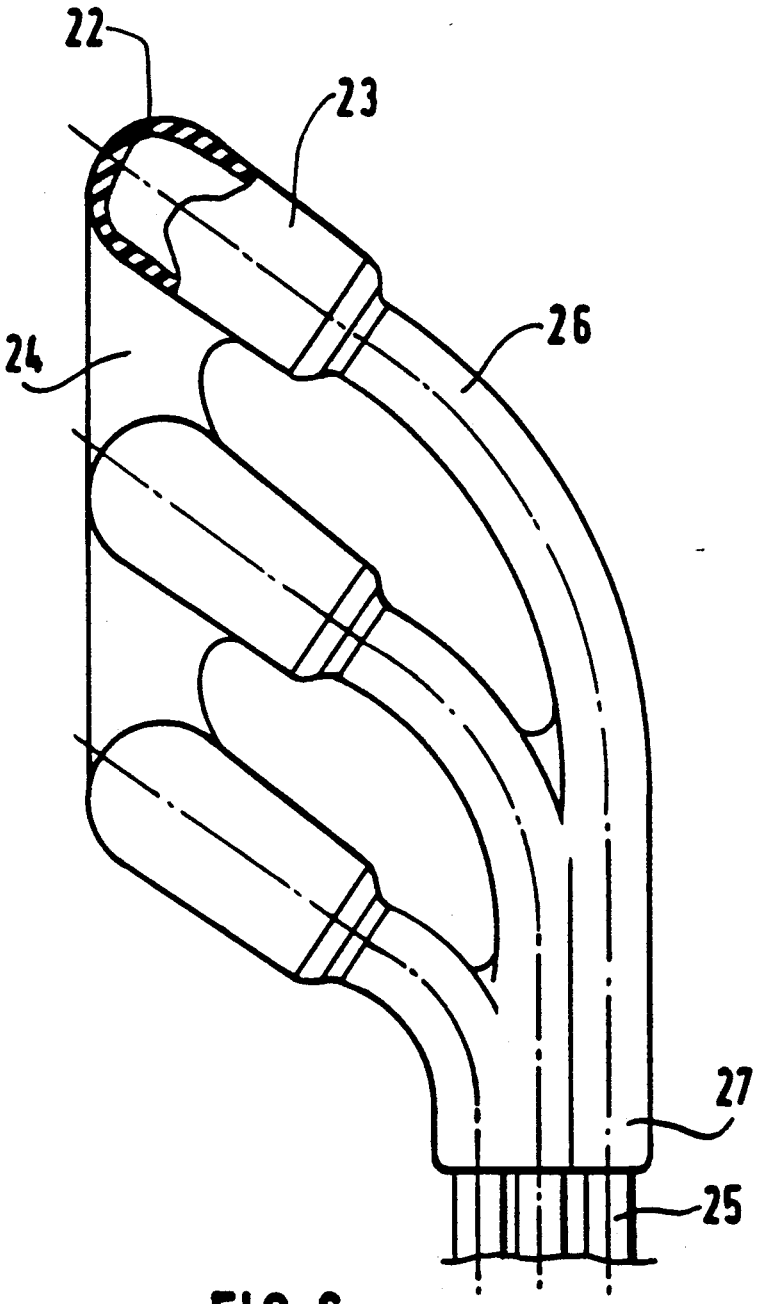
FIG. 6 is a view from above of another set of caps according to the invention.

FIG. 6 shows a set of caps similar to that of FIGS. 3-5, except that the flanges 22 of individual caps 23 are no longer joined via a yoke. Here, the bodies of the caps 23 are joined solely by a yoke 24 parallel to the axis of the output cables 25.

In any case, in this embodiment, the individual outputs 26 of the caps 23 are joined at their end in a single sheath 27.

Figure 7:
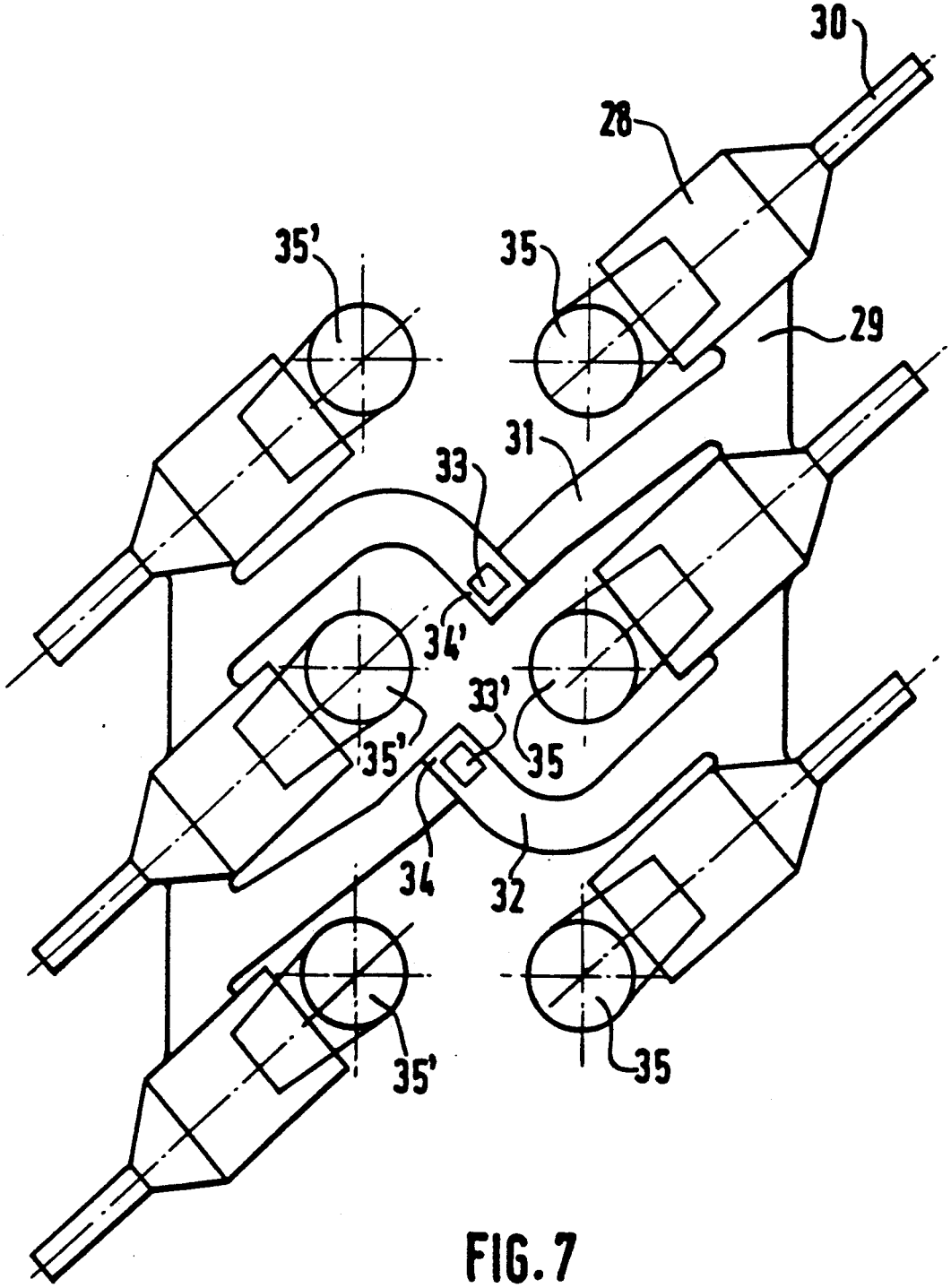
FIG. 7 is a view from above of two sets of caps in another embodiment.

FIG. 7 shows another embodiment in which the caps 28 no longer include a flange, unlike the foregoing embodiments. Here, these caps 23 are joined in sets of three by a yoke 29 parallel to the output cable 30, and this yoke 29 includes two tongues 31 and 32 embodied in one piece with it in its plane.

The tongue 31 is straight and the tongue 32 is elbowed, and each of these tongues includes respective catch means 33 and 34 on its end.

The tongues 31 and 32 project from the yoke 29 on the side opposite the cable 30.

When the set that has just been described is mounted on the aligned elbowed shafts 35 of an ignition device, the catch devices 33 and 34 are in position to cooperate with the catch devices 33' and 34' of the tongues of another set of caps mounted on the shafts 35' in a different row on the same ignition device.

The tongues facing one another are caught by their disconnection of the two sets of cables.

We claim:

1. A connector cap for linkage between an end of an electrical cable and a high-voltage output shaft having an elbowed part of an ignition device said connector cap including:

a flange substantially perpendicular to the end of the cable, on a side of the connector cap opposite the end of the cable, and arranged to be turned down behind a stop surface of the elbowed part of the high-voltage output shaft, for locking the cap counter to a movement in a direction parallel to the end of the cable.

2. The cap of claim 1, including at least one tongue projecting from the side opposite the end of the cable, provided with catch means on its end, the end of the tongue of another cap being located substantially facing the first cap, with the end of its respective cable opposite the end of the cable of the first cap.

3. The cap of claim 1, in which said flange is integral with the cap.

4. The cap of claim 3, in which the flange includes a recess capable of receiving a catch protruberance formed on the surface of the shaft.

5. The cap of claim 4, including a traction tongue (12) on its side opposite the cable output, for putting the flange in place behind the stop surface of the shaft.

6. A set of caps for linkage between an end of each of a plurality of electrical cables and a plurality of elbowed high-voltage output shafts of an ignition device, wherein each cap comprising:

a flange substantially perpendicular to the end of the respective cable, on the side of the cap opposite the end of said cable, and arranged to be turned down behind a stop surface of the elbowed part of the respective shaft;

and said set of caps including a first yoke for joining the set of caps together, said first yoke being integral with said caps in an extension of their respective flanges.

7. The set of caps of claim 6, in which the caps are also joined by a second yoke perpendicular to the first one.

8. The set of caps of claim 7, in which the second yoke is separated from the first yoke, in the area located between the caps.

9. A set of caps for linkage between an end of each of a plurality of electrical cables and a plurality of elbowed high-voltage parallel output shafts of an ignition device, each cap of said set of caps comprising:

a flange substantially perpendicular to the end of the respective cable, on the side of the cap opposite the end of said cable, and arranged to be turned down behind a stop surface of the elbowed part of the respective shaft for locking the cap counter to a movement in a direction parallel to the end of the cable;

at least one tongue projecting from its side opposite the end of the cable, provided with catch means on its end, the end of the tongue of another caps being located substantially facing the first cap, with the end of its respective cable opposite the end of the cable of the first cap; and said set of caps being joined together by a yoke parallel to the ends of the cables.

10. The set of caps of claim 9, including individual ends of cables that are reunited in a common sheath.

* * * * *